United States Patent [19]

Fillion et al.

[11] Patent Number: 4,982,234

[45] Date of Patent: Jan. 1, 1991

[54] EXCEPTION GROUPING FOR MACHINE PROGRAMMING

[75] Inventors: Joseph L. Fillion, Rochester; Thomas J. Herceg, Pittsford, both of N.Y.

[73] Assignee: Xerox Corporation, Stamford, Conn.

[21] Appl. No.: 317,363

[22] Filed: Mar. 1, 1989

[51] Int. Cl.[5] ..... G03G 15/00

[52] U.S. Cl. ..... 355/209; 355/313

[58] Field of Search ..... 355/200, 308, 313, 314, 355/209; 364/146, 188, 189, 518, 521, 525

[56] References Cited

U.S. PATENT DOCUMENTS

| | | | |
|---|---|---|---|
| 4,453,821 | 6/1984 | Smith | 355/313 |
| 4,618,246 | 10/1986 | Nagashima et al. | 355/200 |
| 4,627,715 | 12/1986 | Kikuno | 355/206 |
| 4,673,281 | 6/1987 | Suzuki | 364/525 |
| 4,693,590 | 9/1987 | Umeda | 355/313 |
| 4,711,560 | 12/1987 | Hasaka et al. | 355/200 |
| 4,734,739 | 3/1988 | Inuzaka et al. | 355/308 |
| 4,760,608 | 7/1988 | Suzuki | 382/61 |

FOREIGN PATENT DOCUMENTS

| | | | |
|---|---|---|---|
| 61-57951 | 3/1986 | Japan | 355/313 |
| 61-59461 | 3/1986 | Japan | 355/313 |

*Primary Examiner*—Joan H. Pendegrass

*Attorney, Agent, or Firm*—Ronald F. Chapuran

[57] ABSTRACT

An exception programming device in a reproduction machine capable of being programmed for a production run for producing a first plurality of copies of a document set having a common set of features and a second plurality of copies of the document set having selected features that are exceptions to the common set of features including single document input switches automatically providing selected exception features to the processor for a single identified document, the single document input switches sequentially providing the exception features for each identified single document, and multiple document input switches automatically providing selected exception features in parallel to the processor for a group of identified documents having identical exception features.

10 Claims, No Drawings

EXCEPTION GROUPING FOR MACHINE PROGRAMMING

RELATED APPLICATION

U.S. application Ser. No. 07/164,365 filed Mar. 4, 1988 and entitled TOUCH DIALOGUE USER INTERFACE FOR REPRODUCTION MACHINE and assigned to the assignee herein.

The invention relates to a system for programming reproduction machines such as copiers and printers, and more particularly, to method for job exception programming for such reproduction machines.

As reproduction machines such as copiers and printers become more complex and versatile in the jobs they can do, the user interface between the machine and the operator or user, which in essence permits the dialogue between operator and machine, must necessarily be expanded if full and efficient utilization of the machine is to be realized. A suitable interface must not only provide the controls, displays, and messages necessary to activate, program, monitor, and maintain the machine, but must be able to accurately and efficiently program into the machine instructions for a complex reproduction run. Such reproduction runs generally include a set of documents with most of the documents requiring common features. However, often several documents of the set require special features or exceptions to the common features of most of the documents of the set. This requires operator attention and selection to program the exceptions for each such document requiring an exception.

Various prior art techniques are directed to operator entry of exception information, for example:

U.S. Pat. No. 4,627,715 to Kikuno discloses a programmable copier capable of making copies from a plurality of originals in accordance with copy information temporarily stored in a memory. The copier is provided with a CPU for checking the total number of copies to be made for a copy job;

U.S. Pat. No. 4,693,590 to Umeda discloses an electronic copier selectively operable in a multi-job mode for continuously copying a plurality of groups of documents which differ in copying condition from each other. In response to a copy start signal, single display means displays job data associated with one group of documents which are to be copied;

U.S. Pat. No. 4,711,560 to Hosaka et al. discloses an image processing apparatus having a removable medium containing programs for controlling the apparatus so that the apparatus is capable of performing multiple functions by means of the programs. The programs are controllable by a monitor program provided in the apparatus;

U.S. Pat. No. 4,673,281 to Suzuki discloses an image forming apparatus having a memory for registering copying information. One registration of a plurality of registered copying information is read out and a copying operation is executed in accordance therewith. The copying information registered in the memory is updateable;

U.S. Pat. No. 4,453,821 to Smith discloses a set-up recall apparatus for configuring a copier prior to a production run. The apparatus includes a programmable, non-volatile memory which stores information corresponding to different set-up configurations and a mechanism for selecting one of these configurations and for configuring the copier in accordance therewith;

U.S. Pat. Nos. 4,618,246 to Nagashima et al., 4,734,739 to Inuzuka et al. and 4,760,608 to Suzuki all disclose image forming devices which contain programmable memories for controlling image formation in accordance with parameters set in a memory.

A difficulty with the prior art systems is that often the same exceptions apply to several documents. It is then necessary for the operator to painstakingly select the exceptions (there may be several such as chapter start, special paper or insert, copy quality or image shift) for each document, repeating the same exceptions until the process has been completed for each document. Each time the operator is called upon to make a selection, the possibility of error in selection is increased. Errors in selection can result not only in an inaccurate work product which will have to be at least partially redone, but also can result in conflicting exceptions or requirements which may render the job impossible to initiate. The selections must then be reviewed and rechecked to uncover the source of conflict. This can be very time consuming and inefficient.

It is an object of the present invention, therefore, to provide a new and improved technique for selecting programming exceptions to the standard features in a document set job requirement, and in particular, to provide grouping icon selectors on a user interface screen to be able to program identical exceptions to a group of documents requiring the exceptions, rather than to each document individually. Further advantages of the present invention will become apparent as the following description proceeds and the features characterizing the invention will be pointed out with particularity in the claims annexed to and forming a part of this specification.

SUMMARY OF THE INVENTION

Briefly, the present invention is concerned with an exception programming device in a reproduction machine including a processor including memory for controlling the operation of the reproduction machine and capable of being programmed for a production run for producing a first plurality of copies of a document set having a common set of features and a second plurality of copies of the document set having selected features that are exceptions to the common set of features, comprising an operator interface including a display interconnected to the processor, single document input icons on the display, the single document input icons automatically providing selected exception features to the processor for a single identified document, the single document input icons sequentially providing the exception features for each identified single document, and multiple document input icons on the display, the multiple document input icons automatically providing the selected exception features in parallel to the processor for a group of identified documents having identical exception features. For a better understanding of the present invention, reference may be had to the accompanying drawings wherein the same reference numerals have been applied to like parts and wherein:

IN THE DRAWINGS

FIG. 18 illustrates the Exception Review listing in accordance with the present invention.

DETAILED DESCRIPTION OF THE INVENTION

Figure 1:
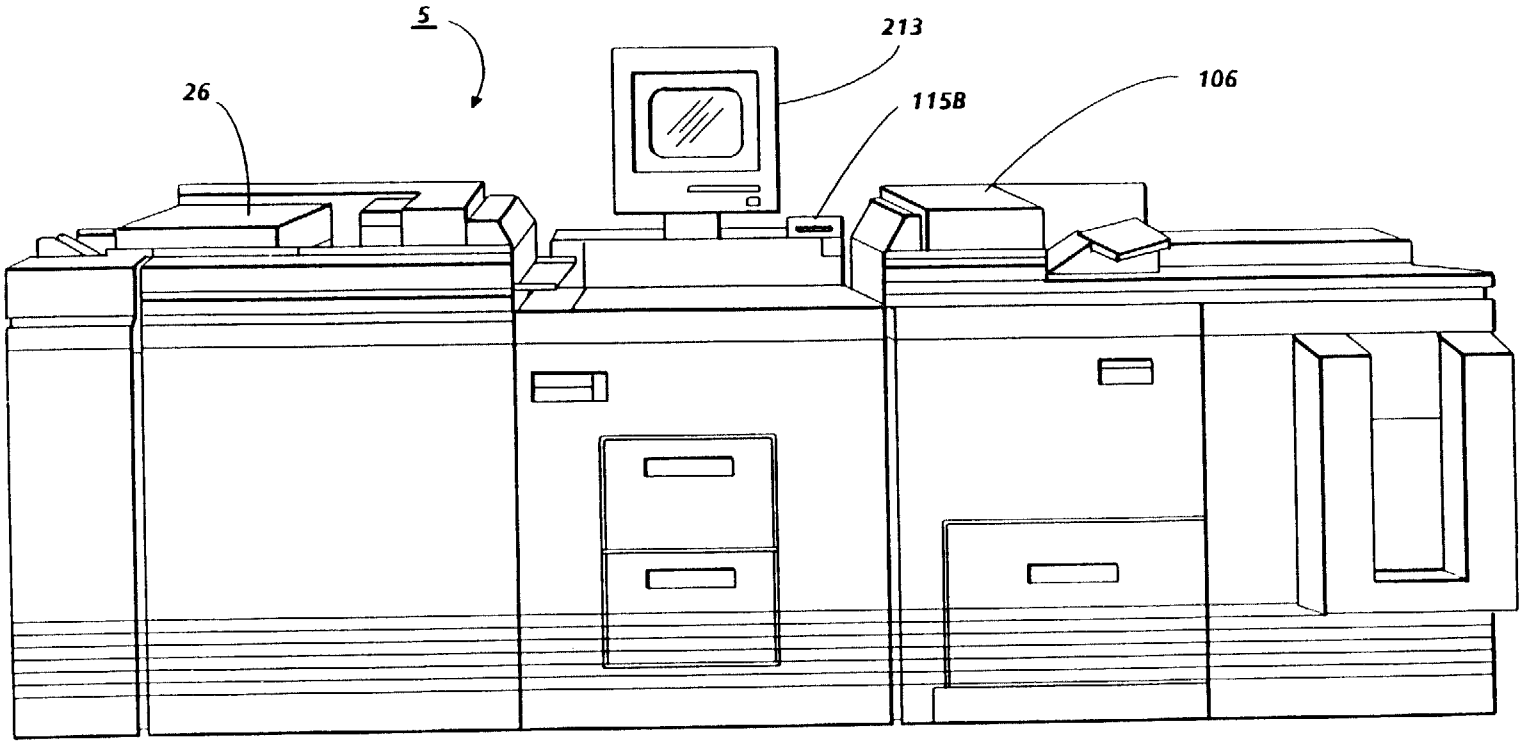
FIG. 1 is an isometric view of an illustrative reproduction machine incorporating the touch dialogue User Interface (U.I.) of the present invention.
Figure 2:
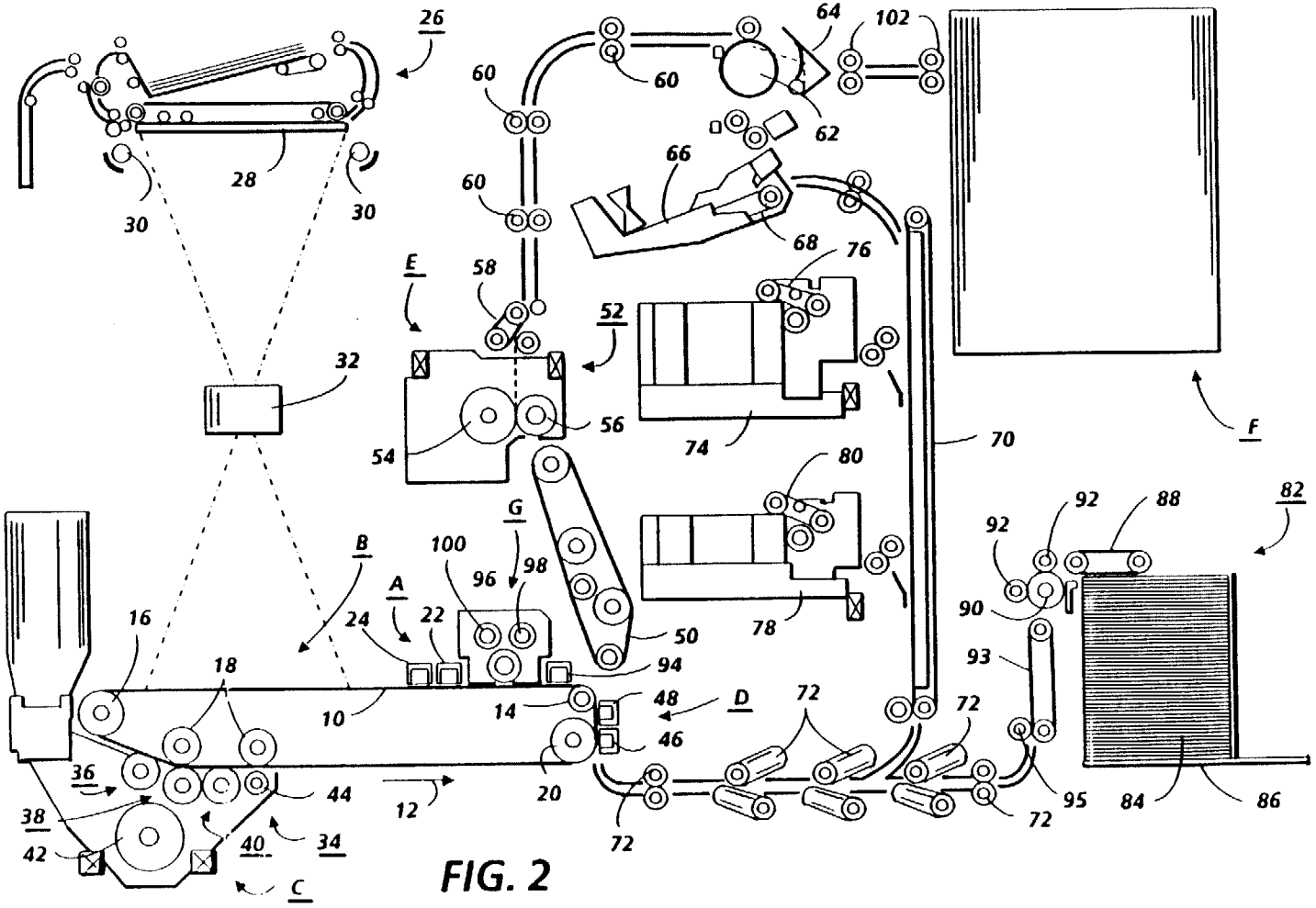
FIG. 2 is a schematic elevational view depicting various operating components and subsystems of the machine shown in FIG. 1.

Referring to FIGS. 1 and 2, there is shown an electrophotographic reproduction machine 5 composed of a plurality of programmable components and subsystems which cooperate to carry out the copying or printing job programmed through a touch dialogue User Interface (U.I.) Machine 5 employs a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station D.

After transfer station D, photoconductive belt 10 passes beneath corona generating device 94 which charges any residual toner particles remaining on belt 10 to the proper polarity. Thereafter, a precharge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of machine 5 are regulated by a controller which preferably comprises one or more programmable microprocessors. The controller provides a comparison count of the copy sheets, the number of documents being recirculated, the number of copy sheets selected by the operator, time delays, jam corrections, etc. As will appear, programming and operating control over machine 5 is accomplished through a User Interface. Operating and control information, job programming instructions, etc. are stored in a suitable memory which includes both ROM and RAM memory types. Conventional sheet path sensors or switches may be utilized to keep track of the position of the documents and the copy sheets. In addition, the controller regulates the various positions of the gates depending upon the mode of operation selected.

Figure 3:
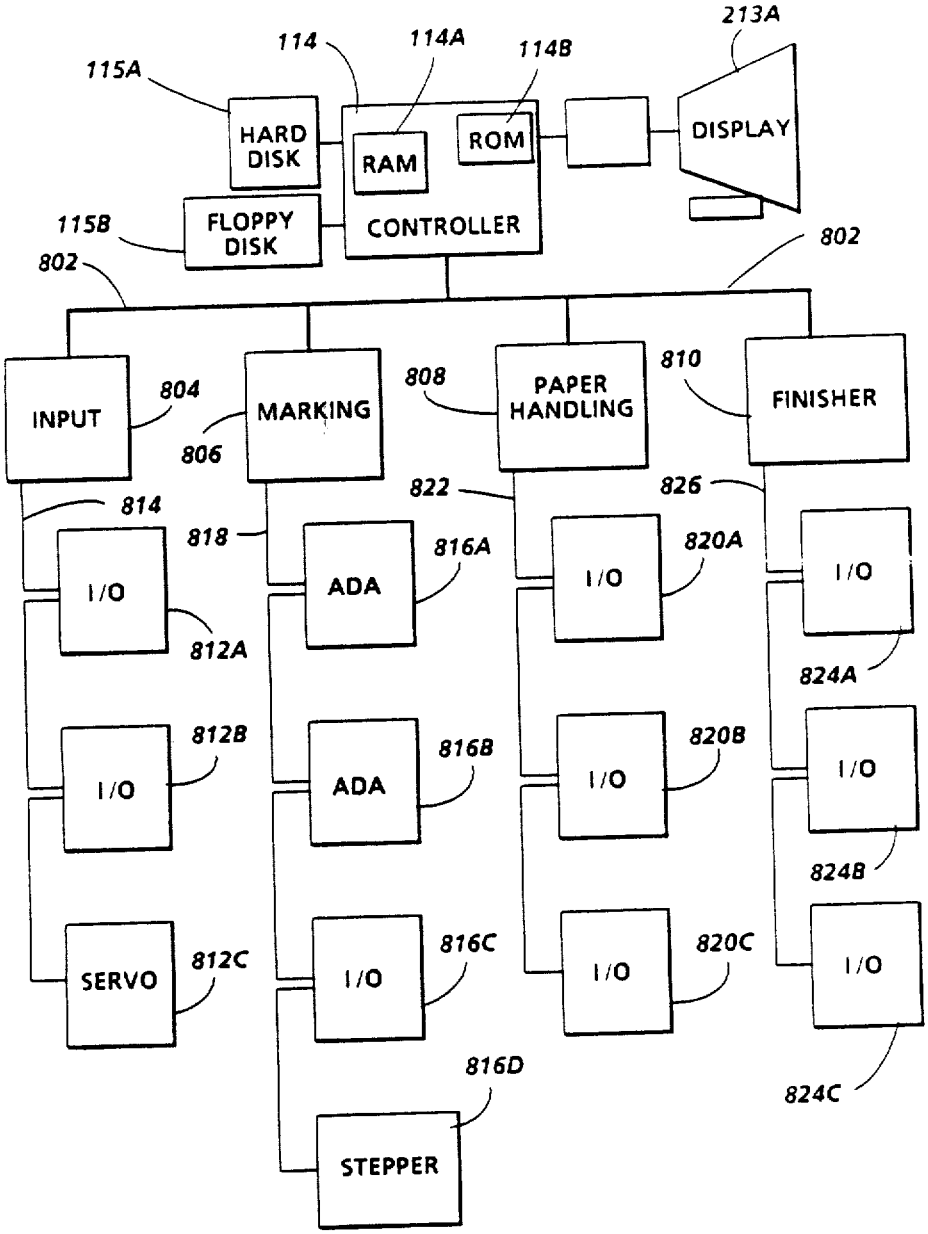
FIG. 3 is a block diagram of the operating control systems and memory for the machine shown in FIG. 1.

With reference to FIG. 3, memory 115 includes a hard or rigid disk drive 115A and a floppy disk drive 115B connected to Controller 114. In a preferred embodiment, the rigid disks are two platter, four head disks with a formatted storage capacity of approximately 20 megabytes. The floppy disks are 3.5 inch, dual sided micro disks with a formatted storage capacity of approximately 720 kilobytes. Preferably, all of the control code and screen display information for the machine is loaded from the rigid disk at machine power up. Changing the data that gets loaded into the machine for execution can be done by exchanging the rigid disk in the machine 5 for another rigid disk with a different version of data or by modifying the contents of the current rigid disk by transferring data from one or more floppy disks onto the rigid disk using the floppy disk drive built into the machine 5. Suitable display 213A of U.I. 213 is also connected to Controller 114 as well as a shared line system bus 302.

The shared line system bus 302 interconnects a plurality of core printed wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B and C to local bus 322, and finisher/binder board 310 connects digital input/output boards 324A, B and C to local bus 326.

Figure 4:
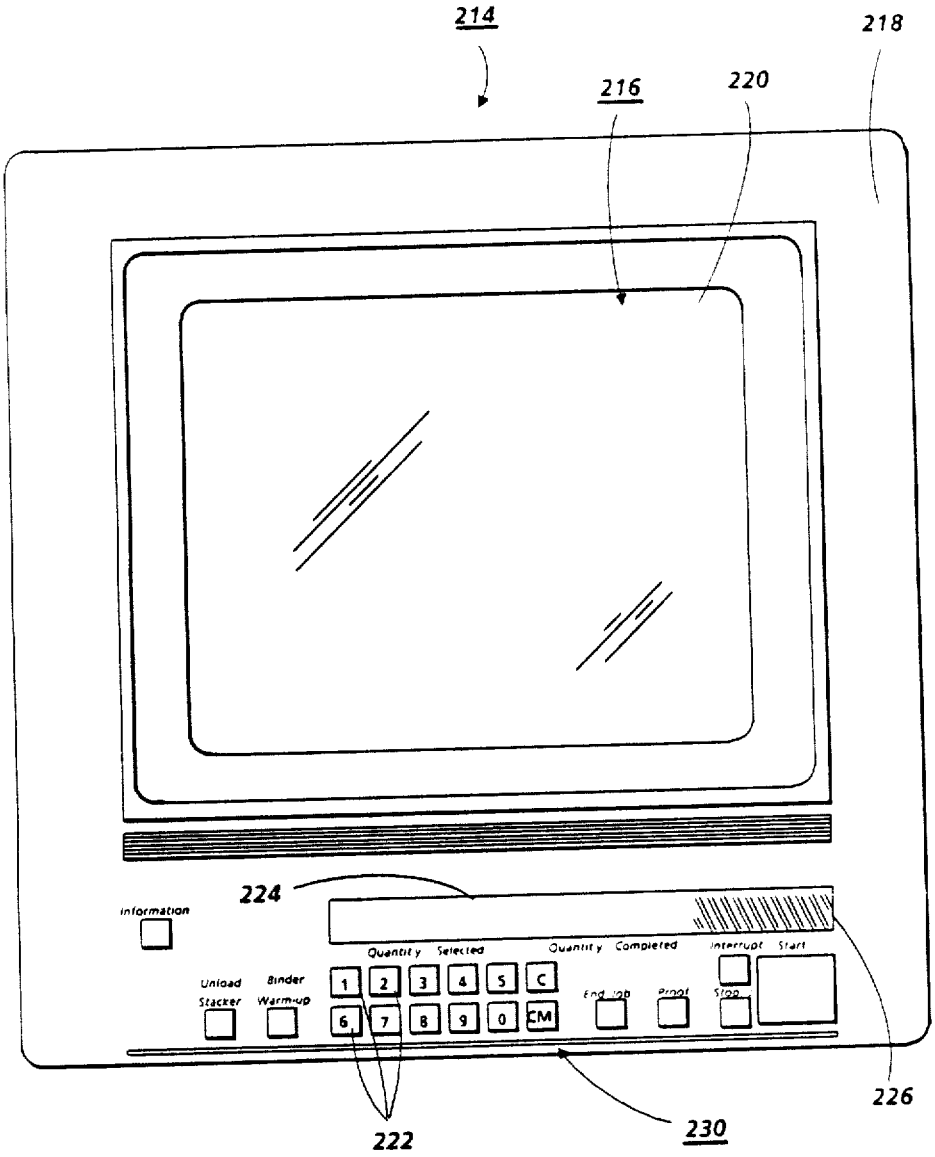
FIG. 4 is a front view of the U.I. color touch monitor showing the soft button display screen and hard button control panel.

Referring to FIG. 4, there is shown the color touch monitor 214 for the touch dialogue U.I. 213 of the present invention. As will appear, monitor 214 provides an operator user interface with hard and soft touch control buttons enabling communication between operator and machine 10. Monitor 214 comprises a suitable color cathode ray tube 216 of desired size and type having a peripheral framework forming a decorative bezel 218 thereabout. Bezel 218 frames a rectangular video display screen 220 on which soft touch buttons in the form of icons or pictograms and messages are displayed as will appear together with a series of hard control buttons 222 and 10 seven segment displays 224 therebelow. Displays 224 provide a display for copy "Quantity Selected", copy "Quantity Completed", and an area 226 for other information.

Hard control buttons 222 comprise "0–9" buttons providing a keypad 230 for programming copy quantity, code numbers, etc.; a clear button "C" to reset display 224; a "Start" button to initiate print; a clear memory button "CM" to reset all dialogue mode features to default and place a "1" in the least significant digit of display 224; an "Unload Stacker" button requesting transfer of the contents of stacker 128; a "Stop" button to initiate an orderly shutdown of machine 5; a "Binder Warm-up" button to initiate warm-up of binder 126; an "Interrupt" button to initiate a job interrupt; a "Proof" button to initiate making of a proof copy; an "End Job" button to end the current job; and an "i" button to initiate a request for information.

Figure 5:
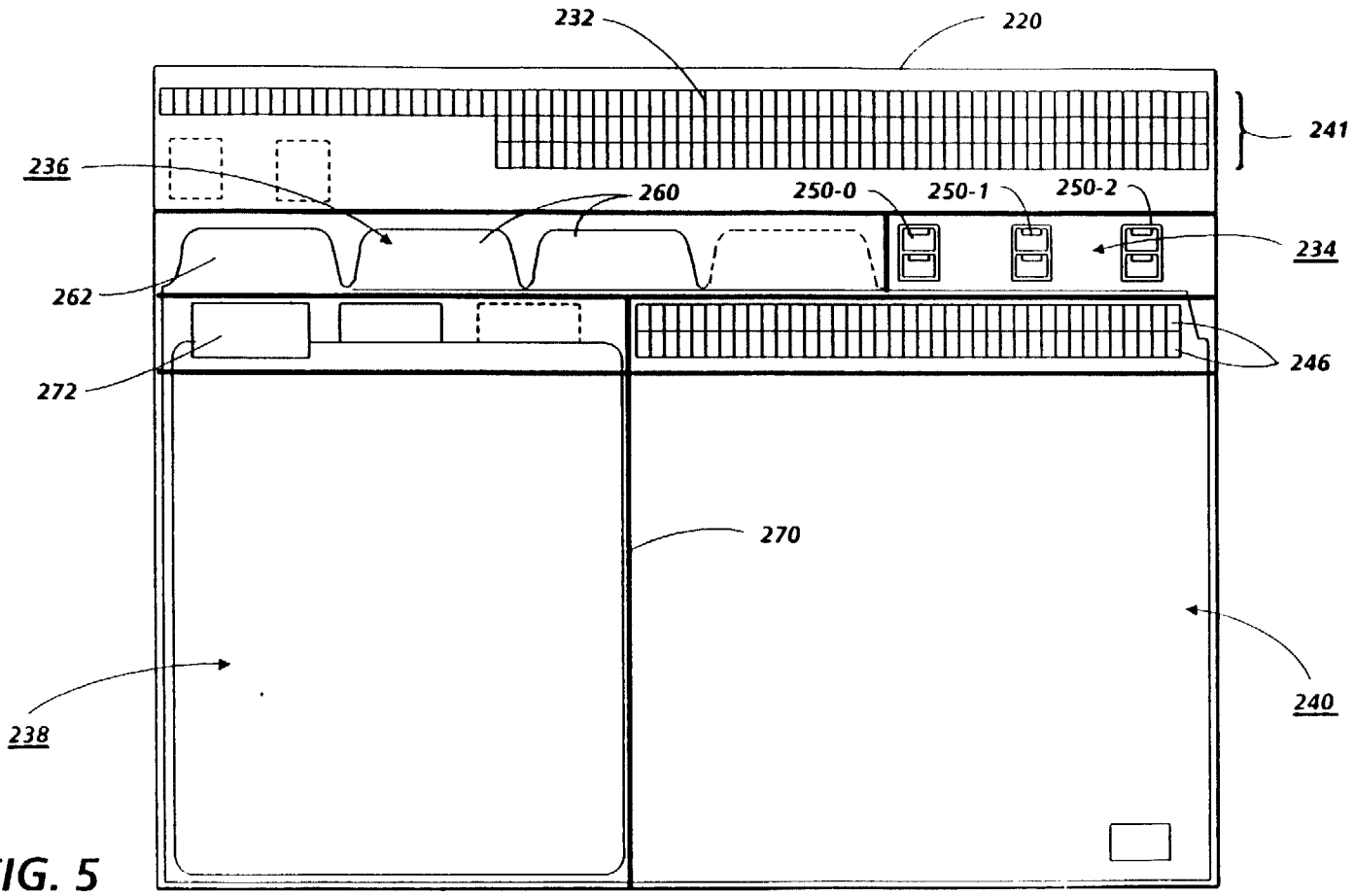
FIG. 5 is a front view of the touch monitor screen with the principal elements of the soft touch dialogue displayed.

Referring now to FIG. 5, for dialogue purposes, screen 220 of monitor 214 is separated into five basic display areas, identified as a message area 232, a dialogue mode selection area 234, a dialogue pathway selection area 236, a scorecard selection area 238, and a work selection area 240.

Message area 232 consists of 3 lines 241 located at the top of screen 220. In addition, two programming conflict message lines 246 are provided in work selection area 240. The dialogue mode selection area 234 comprises an active area containing certain top level dialogue mode controls available to the operator. The mode controls are soft touch buttons 250-0, 250-1, and 250-2 in the form of icons representing file cabinets located on the right side of the screen 220 directly below message area 232.

The dialogue pathway selection area 236 and the scorecard selection area 238 basically simulate a card within a card filing system with primary dialogue pathway file folders 260 and secondary file cards, the latter being referred to as scorecards 270. As will appear, scorecards 270 provide additional programming pathway options. File folders 260 and scorecards 270 are arranged in overlaying relation one in front of the other. The dialogue pathway file folders 260, which are located beneath message area 232 and which extend up into the dialogue mode area 234, each have an outwardly projecting touch tab 262 along the top edge identifying the dialogue pathway represented by the folder, as for example STANDARD, FANFOLD, OVERSIZED, etc. To allow the file folders 260 to be distinguished from one another without the need to reshuffle the folders each time it is desired to display a folder hidden behind the folder currently displayed, each tab 262 is offset from the other so that tabs 262 are always visible whatever folder is displayed.

Scorecard selection area 238 appears in the lower left corner of screen 220 beneath dialogue selection area 234 and extends to the border of work selection area 240. Scorecard selection area 238 contains a file of scorecards 270 which present the features (first level program selections) available with each of the dialogue pathway file folders 260. As seen in FIG. 5 for example, area 238 displays the features (first level program selections) resident with the currently selected scorecard, such selections remaining at previously selected options until either timeout or the "CM" button (FIG. 4) is pressed. Two or three scorecards 270 are typically provided, depending on the dialogue pathway file folder 260 selected. Scorecards 270 each comprise a relatively small file card arranged in overlaying relation to one another so as to simulate a second but smaller card file. Each scorecard 270 has a touch tab 272 displaying the programming pathway options available with the scorecard, such as PROGRAM, EXCEPTION, etc. Scorecard tabs 272 are offset from one another to enable the identity of each scorecard to be determined whatever its position in the scorecard file. Additionally, scorecard tabs 272 are shaped different than the dialogue pathway file folder tabs 262 to prevent confusion.

Work selection area 240 appears in the lower right portion of screen 220, area 240 being beneath the dialogue pathway area 236 and extending from the edge of scorecard selection area 238 to the right side of screen 220. The top two lines 246 of the work selection area 240 are reserved for programming conflicts and prompts with the remaining area used for displaying the feature options (second level program selections) available with the first level program selection that is touched on the scorecard currently selected, an example of which is seen in FIG. 18. As will appear, the operator can scan and make a selection within the work area or pick another scorecard item.

In order for the soft touch buttons (i.e., icons) on screen 220 to provide information regarding both their current selection state and their current status, a display convention is provided that will allow the operator to quickly scan the display and determine current feature selections. Unselected features that are selectable are indicated by an outlined icon with a shadowed background while selected features that are selectable are indicated by a color-filled icon with a shadowed background. Unselected features that are not selectable are indicated by an outlined icon without a shadowed background while selected features that are not selectable are indicated by a color-filled icon without a shadowed background.

In cases where an unselected feature that is not selectable is touched, a message will be displayed in the programming conflict area 246 of screen 220. There are five operating states for U.I. 213 consisting of (1) CURRENT JOB, (2) PROGRAM AHEAD (3) TOOLS, (4) FAULTS, and (5) INFORMATION. The INFORMATION state is entered by means of a hard control button "i" on bezel 218 while the FAULTS state is in the form of a file card that overlays the file cards currently displayed in the event of a fault. The CURRENT JOB, PROGRAM AHEAD, and TOOLS states are entered by pressing the soft touch buttons 250-0, 250-1 and 250-2 respectively displayed on screen 220 in the Dialogue Mode Selection area 234.

For purposes of discussing the Group Exception Programming feature of the present invention, U.I. 213 is presumed to be in the CURRENT JOB state as a result of actuation of soft touch button 250-0. The functions of this state are to inform the operator of the daily tasks that are necessary to keep machine 5 in good working order, to allow the operator to program feature selections for the current job, and to allow the operator to run a copying job. The CURRENT JOB state is sub-divided into three cases: (1) "Job Complete", (2) "Print", and (3) "Job Incomplete". "Job Complete" implies that a job is not in progress and has been completed, "Print" refers to a job in progress, and "Job Incomplete" refers to a job in progress that has either voluntarily or involuntarily been stopped or interrupted.

The CURRENT JOB state can exit to the PROGRAM AHEAD state by touching the PROGRAM AHEAD button 250-1 in any of the "Job Complete", "Job Incomplete" or "Print" cases; or can exit to the INFORMATION state by pressing the "i" hard button on bezel 218; or can exit to the TOOLS state by touching the TOOLS soft touch button 250-2 in either the "Job Complete" or "Job Incomplete" cases. In addition the CURRENT JOB state will automatically enter the FAULT state when a fault occurs.

When entered in the CURRENT JOB state, the dialogue pathway file folders 260 tabbed STANDARD, OVERSIZED, and FANFOLD are displayed providing various dialogue pathway selections in the form of scorecards 270. The function and the behavior of these tabbed file folders within the dialogue pathway selection area 236 for the "Job Complete", "Job Incomplete", and "Print" cases as well as further details of the above described system are further described in application Ser. No. 07/164,365 filed Mar. 3, 1988 and incorporated herein.

With reference to FIGS. 6–18, a second scorecard 270 tabbed EXCEPTION is also included with the STANDARD dialogue pathway file folder 260. This scorecard permits unique programming, referred to herein as exception programming, for individual pages of pages within a job. The Exception Programming features are accessed by pressing the EXCEPTION tab which causes both the EXCEPTION scorecard to appear in the features selection area 238 of screen 222 and a Document Selection Work Area to appear in work selection area 240. (This work area also appears if the DOCUMENT SELECTION Icon 600 on the EXCEPTION scorecard is pressed while in a Feature work area).

The Document Selection work area provides Document Selection Scroll Buttons 604 to allow the operator to select a desired page number, the selected page number being shown in DOCUMENT (SIDE) Window 606, a DELETE Button 608 to permit the operator to delete the selected page number, and a DELETE ALL Button 614 to permit the operator to delete all exception pages. There are also REVIEW SCROLL Buttons 612 to permit the operator to review pages in the EXCEPTIONS PROGRAMMED window 610 or to review the programming of all the documents which contain exceptions. The operator can also scroll through a wrap-around list of pages with associated sides, which in duplex will wrap from 1 up to the maximum number of pages including all side 2's that can be accomplished by the machine document handler 26. When in simplex, only side 1's are displayed.

The EXCEPTION programming scorecard displays a DOCUMENT SELECTION icon 600 to provide the operator with access to the Document Selection work area and display the number of the page currently being displayed in the scorecard. This icon is unavailable in the "Job Incomplete" and "Print" cases. There is also displayed a SHIFT icon 628, a COPY QUALITY icon 630, a 1 SIDED icon 632 to function in a similar manner as the SIDES IMAGED icon 310 in the PROGRAM scorecard, an INSERT icon 634 to allow the operator to select the tray from which inserts will be fed (NON IMAGED), a SPECIAL PAPER icon 636 to allow the user to select the tray from which the paper will be fed for copying and a CHAPTER START icon 638 to allow the operator to designate that the beginning of a chapter in a 1:2 Sides-Imaged program should be printed face-up.

Figure 6:
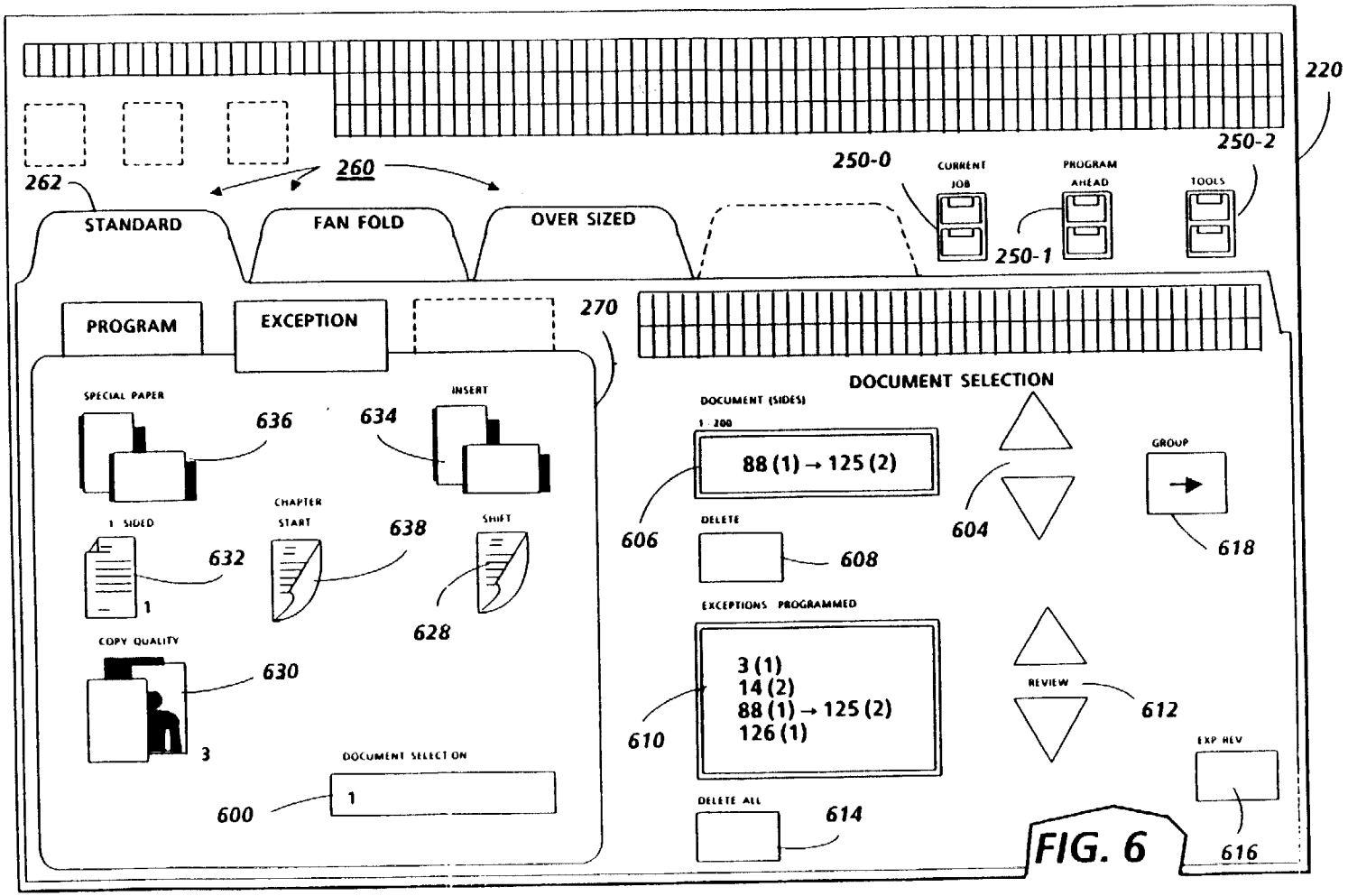
FIG. 6 is a front view of the touch monitor screen shown in FIG. 6 depicting the touch selection exception programming icons that are displayed on selection of the EXCEPTION scorecard.
Figure 7:
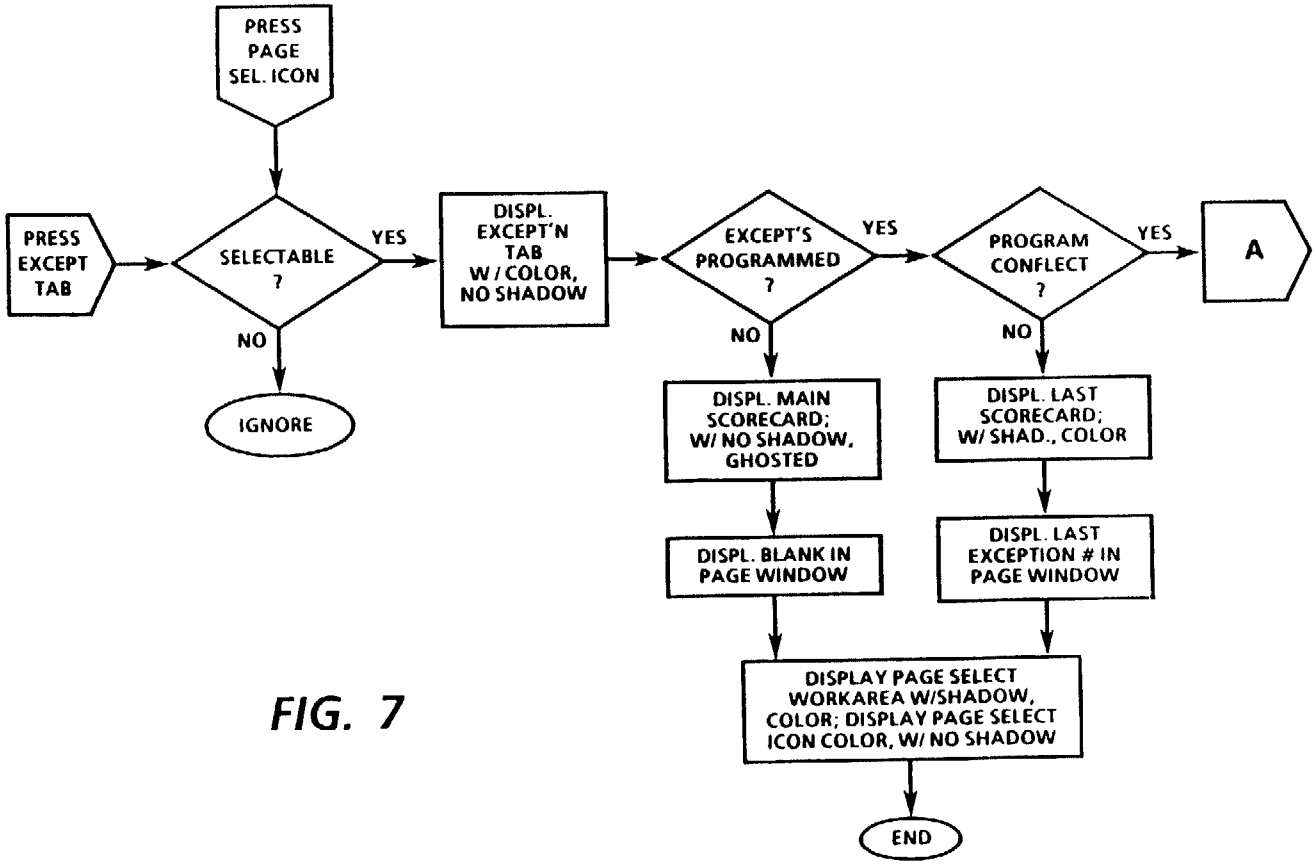
FIG. 7 is a flow chart of the Top Level Entry sequence resulting from touch selection of the EXCEPTION scorecard touch tab.
Figure 8:
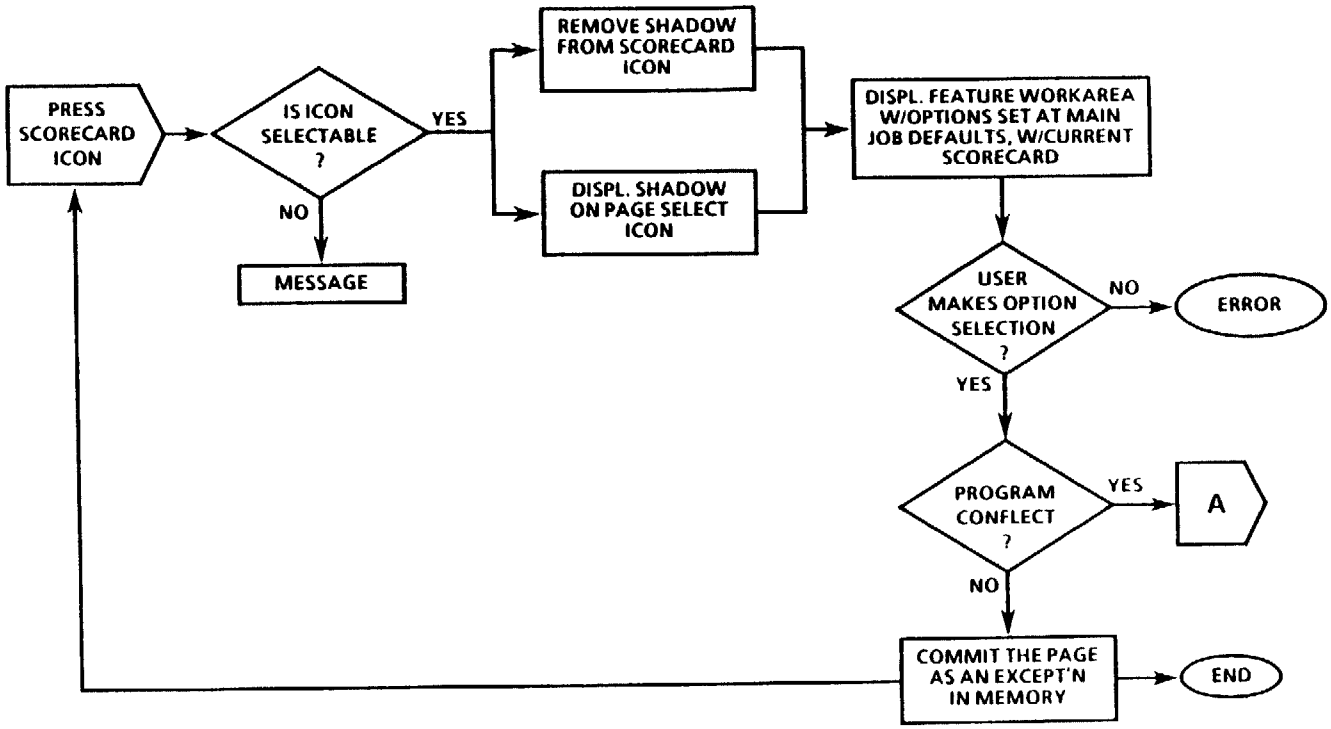
FIG. 8 is a flow chart to the Feature Workarea Entry sequence resulting from touch selection of one of the exception programming icons on the EXCEPTION scorecard.
Figure 9:
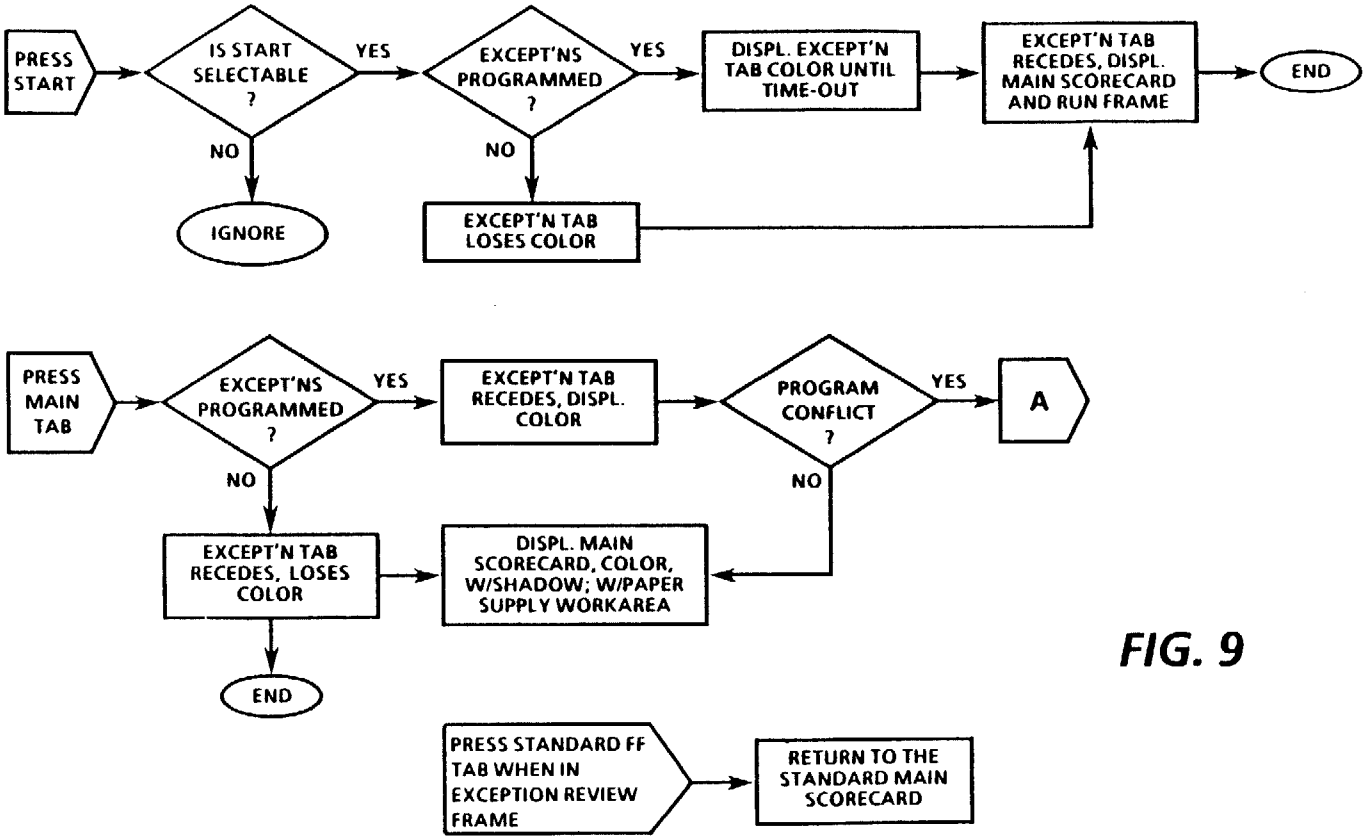
FIG. 9 is a flow chart of the exception programming Exit sequence.
Figure 10:
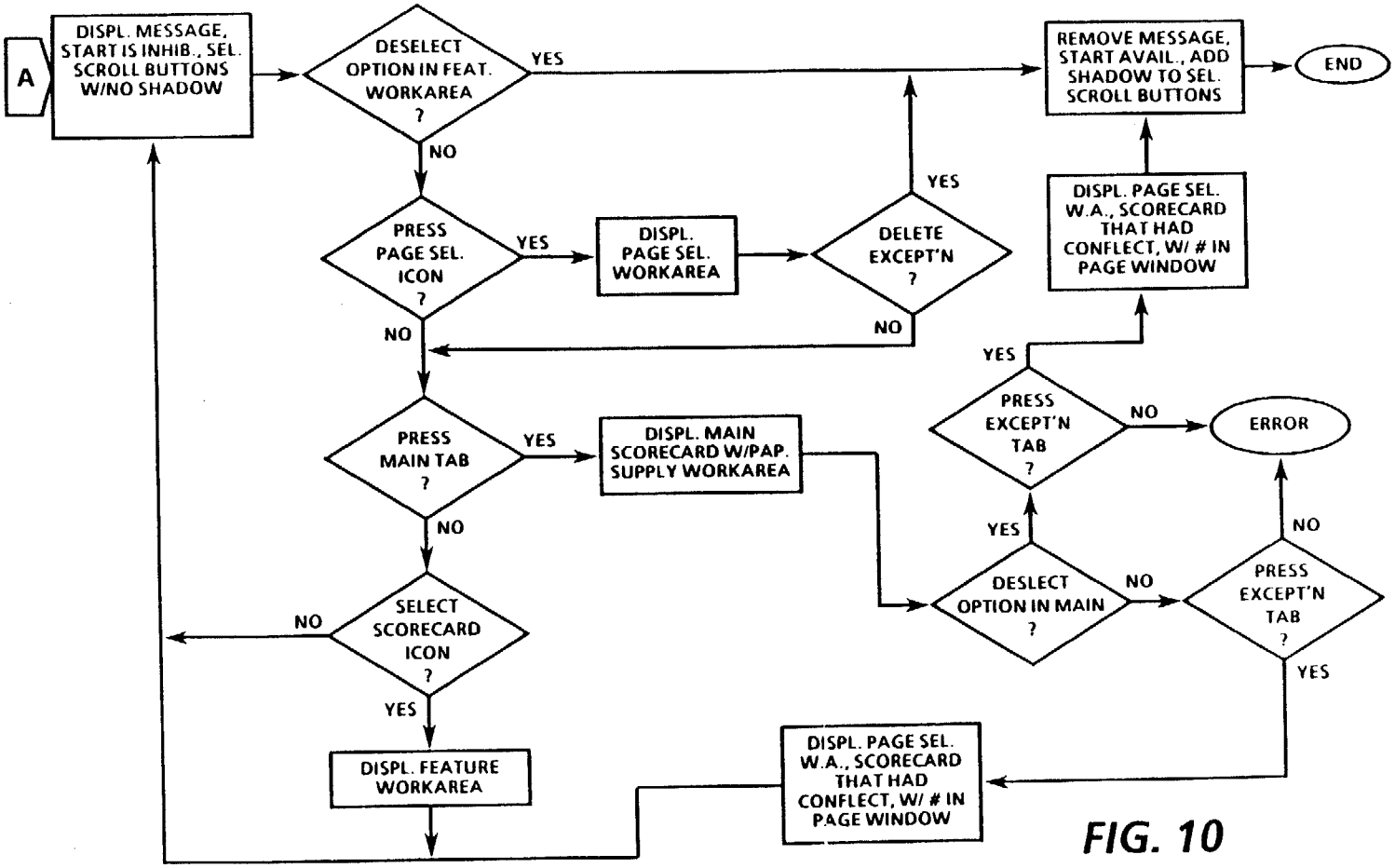
FIG. 10 is a flow chart of the Programming Conflict In Feature Work area sequence during exception programming.
Figure 11:
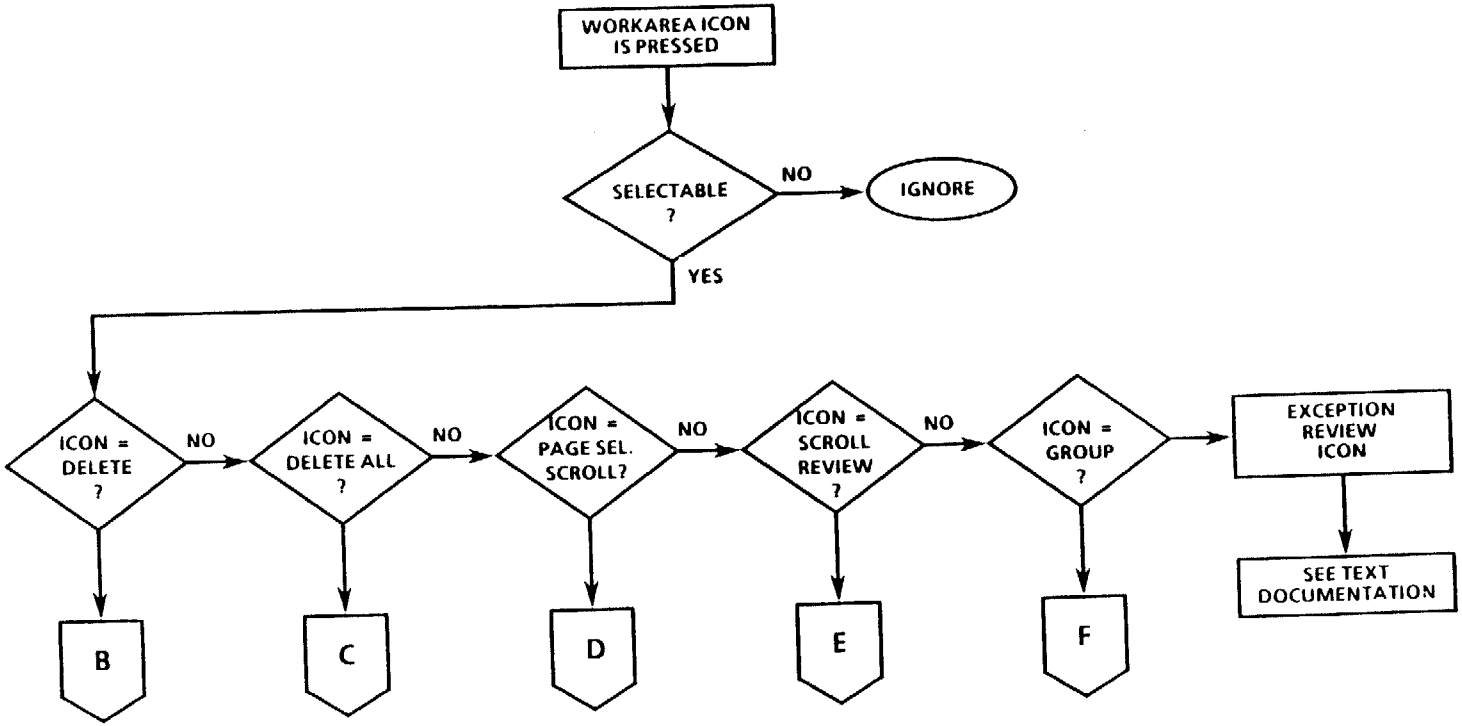
FIG. 11 is a flow chart of the Page Selection Workarea Activity resulting from touch selection of one of the exception programming icons shown in FIG. 6.
Figure 12:
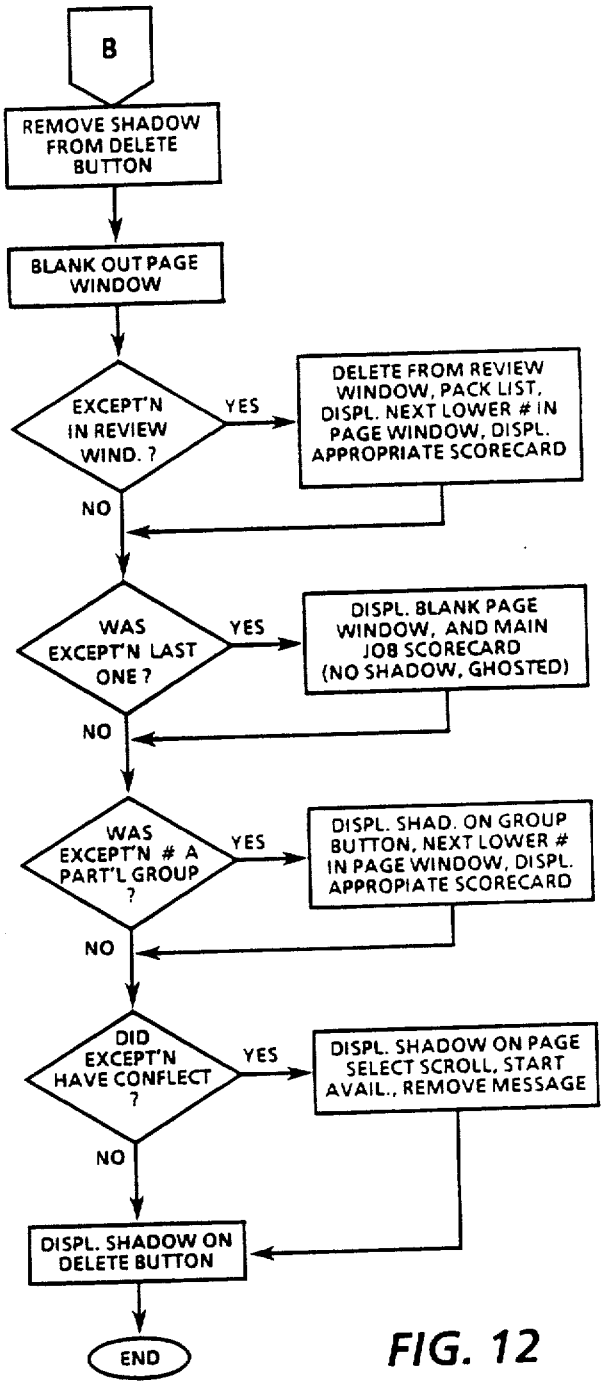
FIG. 12 is a flow chart of the Page Selection Workarea Activity resulting from touch selection of the exception programming Delete Button shown in FIG. 6.
Figure 13:
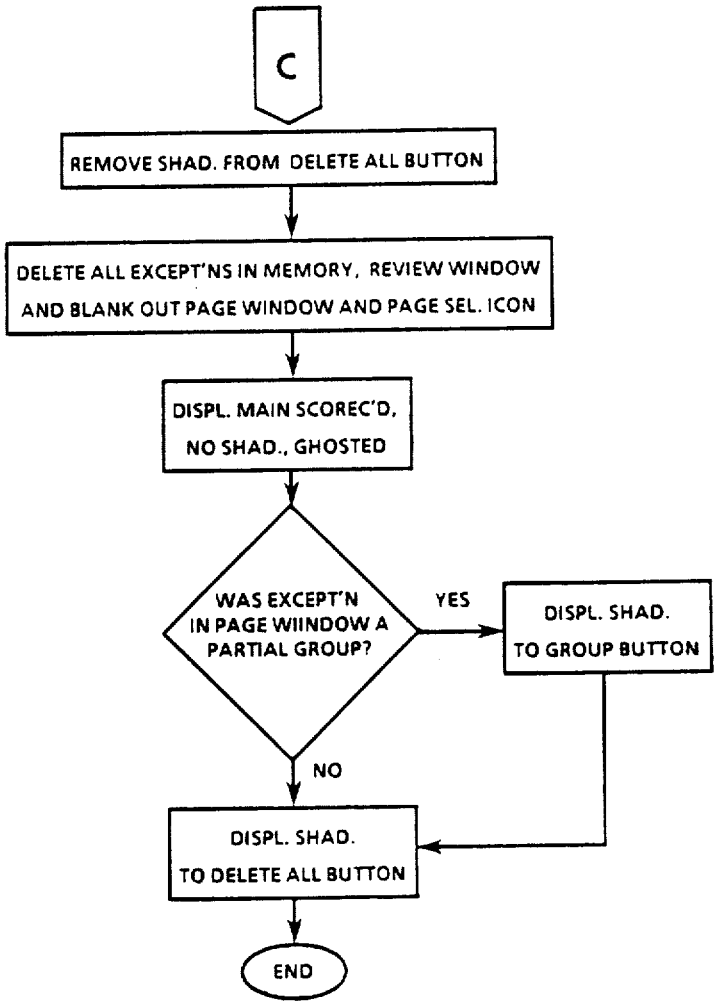
FIG. 13 is a flow chart of the Document Selection Workarea Activity resulting from touch selection of the exception programming Delete All Button shown in FIG. 6.
Figure 14:
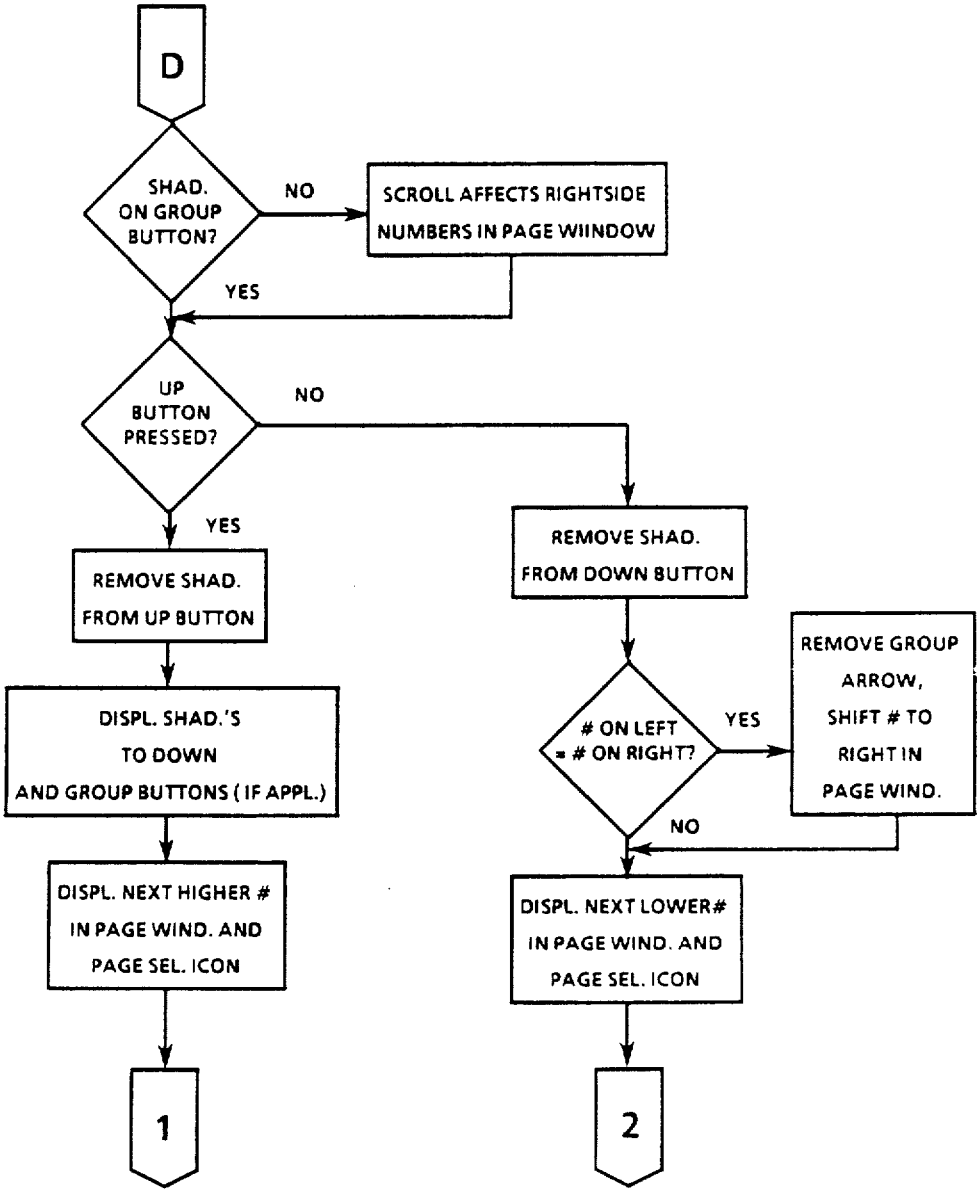
FIGS. 14–15 are flow charts of the Document Selection Workarea Activity resulting from touch selection of the exception programming Document Selection Scroll icon shown in FIG. 6.
Figure 15:
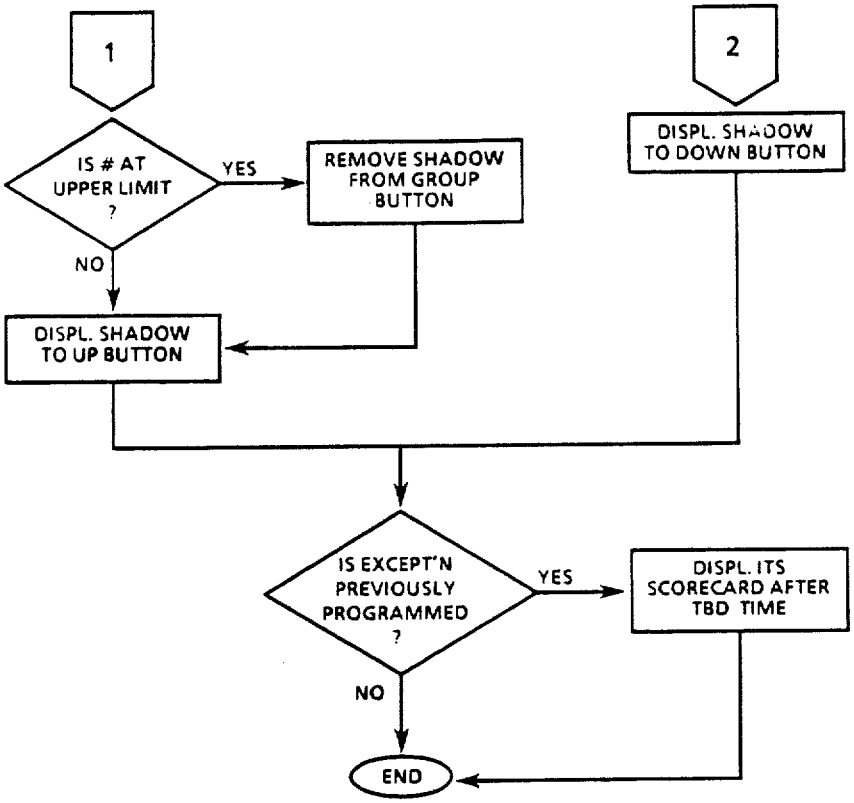
Figure 16:
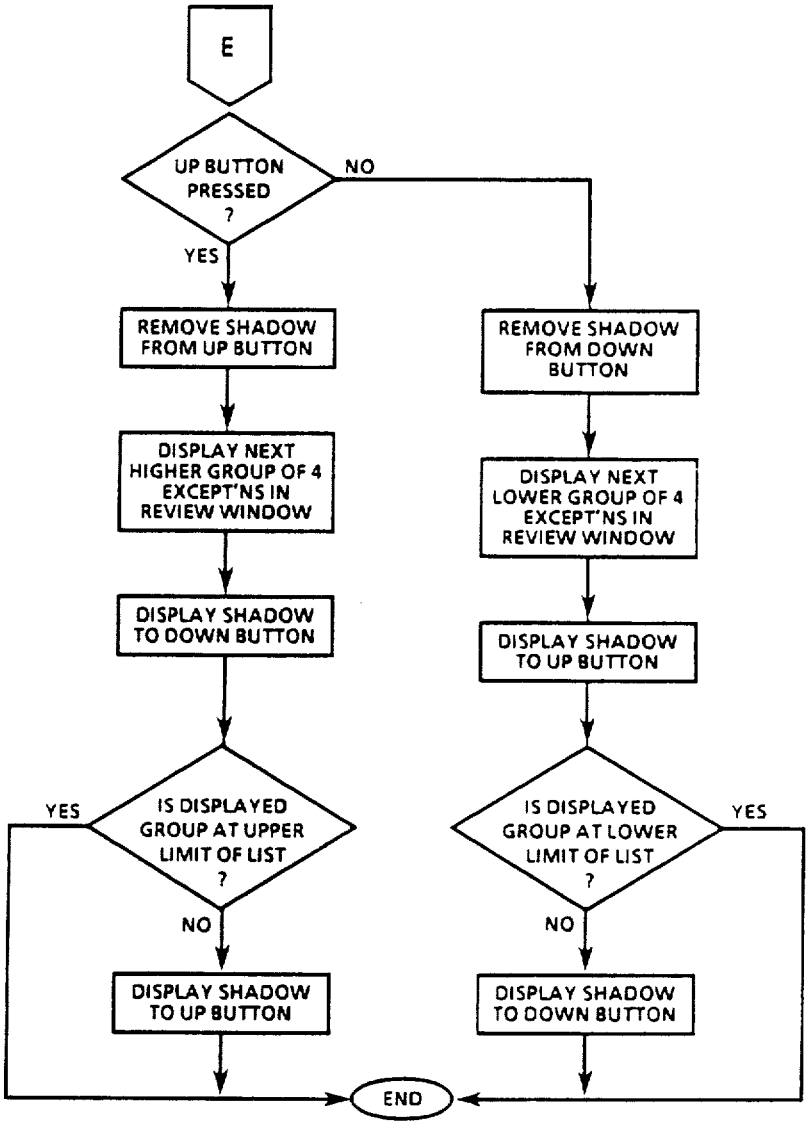
FIG. 16 is a flow chart of the Document Selection Workarea Activity resulting from touch selection of the Exception Review Scroll icon shown in FIG. 6.
Figure 17:
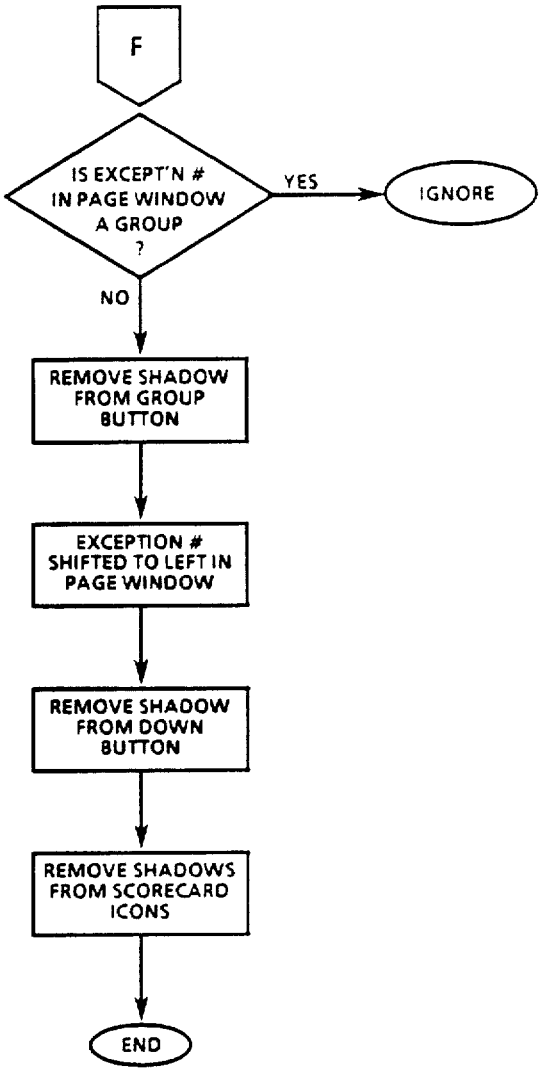
FIG. 17 is a flow chart of the Document Selection Workarea Activity resulting from touch selection of the Group Button icon shown in FIG. 6 in accordance with the present invention.

In accordance with the present invention, a GROUP Button 618 permits the operator, after a page number is entered, to expand to a group of pages. When button 618 is pressed, an arrow appears in page window 606 and the scroll buttons 604 now act upon numbers in the right side of the window. With reference to FIG. 6, upon designating exception programming, the score card area 270 will appear with the special paper, insert, one-sided, chapter start, shift, and copy quality icons as illustrated and also the document Selection Button 600. Automatically, the number 1 will appear in the Document Window 606 in the work area enabling the operator to select any specific exception for document 1. If no exception is intended for document 1, the operator will then scroll up with the Scroll Buttons 604 to document 2, etc. until reaching a document number requiring an exception. After making the appropriate selections for the exception for the document displayed in the window 606 (selections automatically stored in the machine control), the operator will key the document Selection Button 600 in the scorecard area to return back to the work area, to then scroll up or down with the Scroll Buttons 604.

For group selection, the operator will scroll through a sequence of documents with the Scroll Buttons 604 for a group of documents requiring identical exceptions. For example, assume that identical exceptions are to be programmed for all the documents from side one of document 88 to side two of document 125. After the display of side one of document 88, as illustrated by the numeral 88 with number 1 in parenthesis, the operator will engage the Group Button 618 and then scroll up to document 125 side two. The Document Window 606 will illustrate numeral 88 (1) and an arrow pointing to the numeral 125 (2) as illustrated. At this time, the operator can select the appropriate exceptions, such as Special Paper 636 and Shift 628.

These exception features are then automatically programmed for the particular documents as displayed in sequence in the Document Window 606. The operator then activates the document Selection Button 600 to return to the work area and continuing to scroll for the remainder of the document in the set. It should be noted that in the specific example, a group of exceptions was applied to a sequence of documents displayed in the document display 606. However, it is in the scope of the present invention, to be able to arbitrarily select specific documents and document sides out of sequence by use of the group switch 618 to be able to apply the identical exceptions to such arbitrarily selected group of documents.

In accordance with another feature of the present invention, if an operator decides that the selected exceptions are in error or decides to change to a different programming scheme, the activation of the Delete Button 608 will delete all exceptions that have been automatically stored for the given group or set of documents in the Document Window 606. With reference to the Exceptions Programmed Window 610, in a specific embodiment, up to ten program exceptions including a group of selections can be displayed in the Programmed Window 610. For example, as illustrated, there is shown document 3, page 1, document 14, side 2, a group of selections from document 88, side 1 to document 125, side 2, and document 120, side 1. By use of the Review Scroll Buttons 612, the operator can scroll through the remaining exceptions. It should also be noted that other means of displaying the exceptions are available such as numerical key input to input exactly the specific documents to be displayed in the Programmed Window 610. As already described, the Delete All Button 614 allows the operator to delete the exceptions for all the documents that have been automatically selected. In accordance with another feature of the present invention, an Exception Review Key 616 is provided to display a table identifying the exception original and the selected exceptions pertaining to that original as illustrated in FIG. 18.

In operation, to make group document selections, it is necessary in a specific embodiment for the operator to have selected the current program file cabinet, the standard file folder, and the program scorecard tab. Initially, but not necessarily, the operator will make all feature selections for the entire job before programming any exceptions and then activate the exception scorecard tab. The operator will then activate the scrolling switches 604 in the work area and begin the document selection from 1 to 250 documents. In a specific embodiment, the maximum number of exceptions per copy job is 100 and after reaching 100, the document numbers become unselectable. As each document selection is made the document is registered in the Document Window 606. At the same time, the scorecard reflects the exceptions programmed for the document number in the window. The Review Scroll Buttons 612 can be used to review what exceptions have been programmed. After the first document is selected the features in the scorecard area becomes selectable (shaded) and programming exceptions can continue.

After programming each exception document, the operator touches the Document Selection Button 600 in order to return to the document selection work area. After each programming selection, the document related numbers appear in the Exceptions Programmed Window 610. The review arrows do not become selectable until more than four documents have been programmed.

In order to group exceptions, the operator first touches the document selection Scroll Buttons 604 to register the first document in the document grouping. Next the operator touches the group button 618 and arrow will appear after the number selected in the Document Window 606, indicating a need for another number. The operator will then scroll the Scroll Buttons 604 until the last number for the group is reached. Once the last number for the group is reached, the operator will select the selection programming features to automatically program those features for the documents within the group. It should be noted that it is within the scope of the present invention that in selecting a feature before the last document number in the group has been identified will cancel the entire group selection.

By touching the Delete Button 608, the last programmed document exceptions will be deleted and by touching the Delete All Button 614, all the exception documents programmed will be deleted. By touching the Exception Review Button 616, a total listing of all the exceptions programmed for the copy job will be displayed as the Scroll Buttons 612 are activated. In a preferred embodiment, documents that have been programmed incorrectly will appear in amber along with a conflict message explanation.

While the invention has been described with reference to the structure disclosed, it is not confined to the details set forth, but is intended to cover such modifications or changes as may come within the scope of the following claims.

We claim:

1. In a reproduction machine having a control and memory for providing a set of reproductions of a single document set, the reproductions generally having first features, the method of selecting predetermined documents of the document set to receive second and third features different from said first features including the steps of:

programming the machine to provide said first features to predetermined documents of the document set, automatically storing in memory indications of the programmed first features, selectively identifying predetermined individual documents of the document set to receive said second features, automatically sequentially storing in memory indications of the programmed second features for each individual document to receive the second features, wherein the improvement comprises the steps of:

selectively consolidating as a group those documents of the single document set to receive the third features and automatically storing in memory indications of the programmed third features for the consolidated group to receive the third features.

2. In a reproduction machine including a processor including memory for controlling the operation of the reproduction machine and capable of being programmed for a production run for producing a plurality of copies of a single document set a first portion of the single document set having a common set of features and a second portion of the document set having selected features that are exceptions to the common set of features, an exception programming device comprising:

an operator interface including a display interconnected to the processor, first document input means electrically connected to the display, the first document input means automatically providing selected exception features to the processor for a single identified document, and second document input means electrically connected to the display, the second document input means automatically providing the selected exception features to the processor for a group of identified documents having identical exception features.

3. An exception programming device in a reproduction machine having a control and plural interactive subsystems cooperable to produce copies from a single set of document originals, some of the copies having first features, other of the copies having second features different from the first features comprising:

a screen providing a display of options to select features for each document to be copied;

input responsive means to enable the option selections to be identified and entered into the control;

first means to enter exception features for single documents and second means to enter instantaneously identical exception features for a selected group of documents.

4. The exception programming device of claim 2 wherein the display includes an exception programmed window and including the means to display a plurality of single documents or groups of documents selected for exception programming.

5. The exception programming device of claim 4 including means to scroll single documents or groups of documents selected for exception programming within said exception programmed window.

6. The exception programming device of claim 2 including the means to display a document and itemizing the exception features related to the document.

7. The exception programming device of claim 6 including means providing the option to delete selected documents from said means to display.

8. In a reproduction machine having a control and memory for providing a set of reproductions of a single document set, the reproductions generally having first features, the method of selecting predetermined groups of documents of the document set to receive second features different from said first features including the steps of:

programming the machine to provide said first features to predetermined documents of the document set, automatically storing in memory indications of the programmed first features, selectively identifying a group of documents of the document set to receive said second features, automatically storing in memory indications of the programmed second features for said group of documents to receive the second feature and providing a display identifying a document and itemizing the exception features related to the document.

9. The method of claim 8 including the step of displaying in an exceptions programmed window a group of documents to receive said second feature.

10. The method of claim 9 including the step of scrolling single documents on identified groups of documents in said exceptions programmed window.

* * * * *

UNITED STATES PATENT AND TRADEMARK OFFICE

CERTIFICATE OF CORRECTION

PATENT NO. : 4,982,234

DATED : Jan. 1, 1991

INVENTOR(S) : Joseph L. Filion and Thomas J. Herceg

It is certified that error appears in the above-identified patent and that said Letters Patent is hereby corrected as shown below:

On the title page, under item [19], "Fillion" should be --Filion--; and in item [75], "Joseph L. Fillion" should be --Joseph L. Filion--.

The title page should be deleted to be replaced with the attached title page showing the illustrative figure.

The 18 Drawing Sheets, consisting of Figs. 1 through 18, as shown on the attached pages, should be inserted.

Signed and Sealed this

Nineteenth Day of May, 1992

*Attest:*

DOUGLAS B. COMER

*Attesting Officer*

*Acting Commissioner of Patents and Trademarks*

United States Patent [19]

Filion et al.

[11] Patent Number: 4,982,234

[45] Date of Patent: Jan. 1, 1991

[54] EXCEPTION GROUPING FOR MACHINE PROGRAMMING

[75] Inventors: Joseph L. Filion, Rochester; Thomas J. Herceg, Pittsford, both of N.Y.

[73] Assignee: Xerox Corporation, Stamford, Conn.

[21] Appl. No.: 317,363

[22] Filed: Mar. 1, 1989

[51] Int. Cl.[5] ..... G03G 15/00

[52] U.S. Cl. ..... 355/209; 355/313

[58] Field of Search ..... 355/200, 308, 313, 314, 355/209; 364/146, 188, 189, 518, 521, 525

[56] References Cited

U.S. PATENT DOCUMENTS

| | | | |
|---|---|---|---|
| 4,453,821 | 6/1984 | Smith | 355/313 |
| 4,618,246 | 10/1986 | Nagashima et al. | 355/200 |
| 4,627,715 | 12/1986 | Kikuno | 355/206 |
| 4,673,281 | 6/1987 | Suzuki | 364/525 |
| 4,693,590 | 9/1987 | Umeda | 355/313 |
| 4,711,560 | 12/1987 | Hasaka et al. | 355/200 |
| 4,734,739 | 3/1988 | Inuzaka et al. | 355/308 |
| 4,760,608 | 7/1988 | Suzuki | 382/61 |

FOREIGN PATENT DOCUMENTS

| | | | |
|---|---|---|---|
| 61-57951 | 3/1986 | Japan | 355/313 |
| 61-59461 | 3/1986 | Japan | 355/313 |

*Primary Examiner*—Joan H. Pendegrass
*Attorney, Agent, or Firm*—Ronald F. Chapuran

[57] ABSTRACT

An exception programming device in a reproduction machine capable of being programmed for a production run for producing a first plurality of copies of a document set having a common set of features and a second plurality of copies of the document set having selected features that are exceptions to the common set of features including single document input switches automatically providing selected exception features to the processor for a single identified document, the single document input switches sequentially providing the exception features for each identified single document, and multiple document input switches automatically providing selected exception features in parallel to the processor for a group of identified documents having identical exception features.

10 Claims, 18 Drawing Sheets

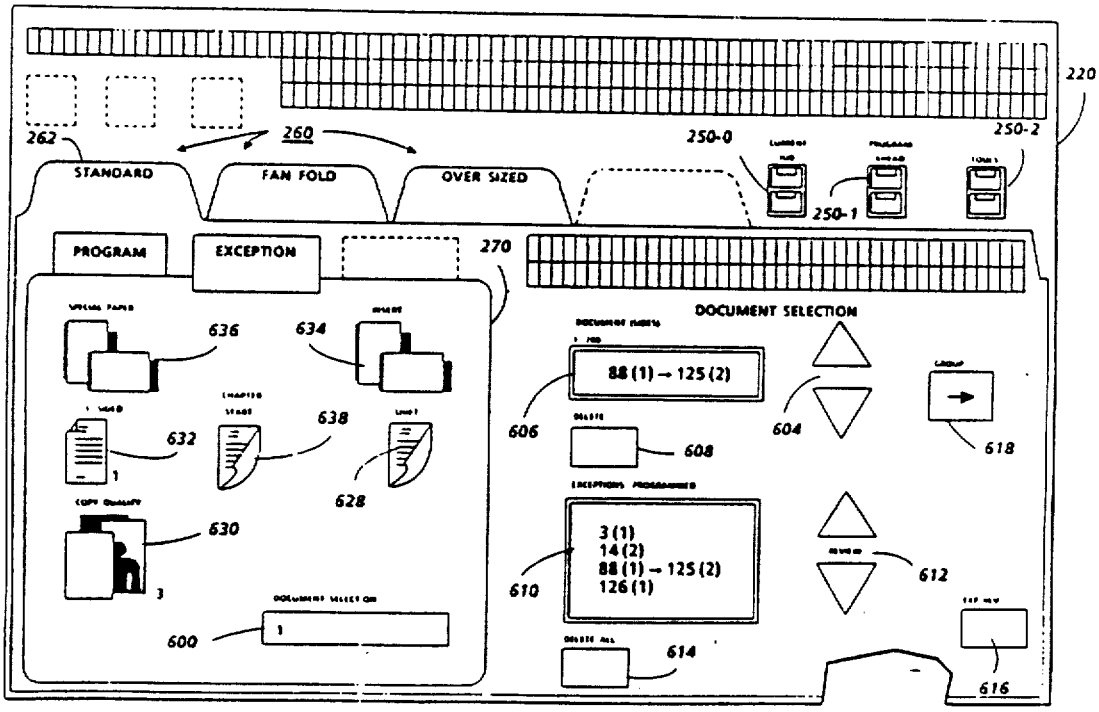

EXCEPTION REVIEW

| DOCUMENT (SIDES) | SPECIAL PAPER | INSERT | 1 SIDED | CHAPTER START | SHIFT | COPY QUALITY |
|---|---|---|---|---|---|---|
| 2 (1) | TRAY 1 | | | | | X |
| 5 (1) | TRAY 1 | | | X | | |
| 10 (1) → 12(2) | | | | | | XX |
| 21 (2) | | TRAY 2 | | | | |

FIG. 18